United States Patent [19]

Simon

[11] Patent Number: 4,974,617

[45] Date of Patent: Dec. 4, 1990

[54] PROCESS AND APPARATUS FOR REMOTELY CLEARING A LIQUID-FILLED PIPE

[75] Inventor: Jacques Simon, Barneville, France

[73] Assignee: Cogema Compagnie Generale des Matieres Nucleaires, France

[21] Appl. No.: 286,986

[22] PCT Filed: Mar. 3, 1988

[86] PCT No.: PCT/FR88/00120

§ 371 Date: Oct. 26, 1988

§ 102(e) Date: Oct. 26, 1988

[87] PCT Pub. No.: WO88/06496

PCT Pub. Date: Sep. 7, 1988

[30] Foreign Application Priority Data

Mar. 4, 1987 [FR] France ..... 87 02933

[51] Int. Cl.[5] ..... B08B 3/12; B08B 5/00

[52] U.S. Cl. ..... 134/22.12; 134/22.18; 15/104.07; 15/316 R

[58] Field of Search ..... 134/22.12, 22.18

[56] References Cited

U.S. PATENT DOCUMENTS

| | | | |
|---|---|---|---|
| 2,351,163 | 6/1944 | Thomas | 134/22.18 |
| 2,560,728 | 7/1951 | Lee | 134/22.12 |
| 4,645,542 | 2/1987 | Scharton et al. | 134/22.12 |

FOREIGN PATENT DOCUMENTS

| | | | |
|---|---|---|---|
| 837971 | 3/1970 | Canada | 134/22.12 |
| 686842 | 2/1953 | United Kingdom . | |

*Primary Examiner*—Asok Pal

[57] ABSTRACT

For clearing or unblocking a pipe (10) filled with a liquid (12) and in which a plug (14) has formed, an apparatus (16) is connected to said pipe. This apparatus applies to the liquid harmonic-rich longitudinal pressure waves and which are preferably constituted by a pulse train. By means of a regulatable compliance volume (28), the harmonic n of the resonant frequency of the incompressible mode of the liquid (12)-pipe (10) system is adjusted, so that its frequency is equal to that of harmonic 1 of the resonant frequency of the compressible mode of the system (n preferably being equal to 1, 2 or 3). This makes it possible to take advantage of the resonances of the compressible and incompressible modes of the system by using a low exciting frequency (below 20 Hz), which reduces the risks of the pipe (10) fracturing or bursting.

6 Claims, 2 Drawing Sheets

PROCESS AND APPARATUS FOR REMOTELY CLEARING A LIQUID-FILLED PIPE

DESCRIPTION

The present invention relates to a process making it possible to remotely clear or unblock a liquid-filled pipe, as well as to an appartaus for performing this process.

In numerous industrial installations, particularly in the chemical and nuclear industries, there are pipes in which solid particle-containing liquids circulate. These particles create deposits on the walls of the pipes and frequently lead to the formation of plugs.

When the plug has formed in an accessible part of the pipe, the disintegrating of the plug can be brought about by introducing a mechanical member, generally called a ferret into the pipe. However, this method cannot be used when the plug has foamed in an inaccessible part. Moreover, in the nuclear industry, it is not satisfactory because it leads to a direct contact between the clearing member and the generally radioactive products contained in the pipe.

Another known clearing or unblocking method consists of pressurizing the blocked part of the pipe, by directly connecting the latter to the discharge orifice of a test pump. Although this method does not suffer from the disadvantages of mechanical clearing, it sometimes leads to the reverse effect from that which is desired. Thus, in certain cases, the pressurizing of the pipe has the effect of compressing the plug, which makes it virtually impossible to clear by known methods.

The present invention relates to a novel process making it possible to remotely clear a liquid-filled pipe, no matter what the location where the plug has formed and without any risk of compressing said plug.

To this end and according to the invention, a process for the remote clearing of a liquid-filled pipe is proposed, which is characterized in that to one end of the pipe is applied harmonic-rich longitudinal pressure waves at an exciting frequency $f_e$ equal to the natural frequency (harmonic 1) of the incompressible mode of the system, in such a way that the harmonic n of said frequency is at the natural frequency (harmonic 1) of the compressible mode of the system, n being an integer at least equal to 1.

This adaptation of the compressible and incompressible modes is obtained by varying the compliance of the liquid-pipe system.

Preferably, the pressure waves used are formed by low frequency, periodic, harmonic-rich pulse trains (frequency preferably below 20 Hz).

The compliance of the system is regulated in such a way that the harmonic 1 of the resonant frequency of the incompressible mode has a harmonic of frequency equal to the frequency of harmonic 1 of the resonant frequency of the compressible mode. In this case, the ratio between the duration I of a pulse and its period T is adjusted to a value for which the coefficient of the harmonic 1,2 or 3 of the development in the Fourier series of the pulse train is at a maximum.

The invention also relates to an apparatus making it possible to perform the remote clearing process as defined hereinbefore.

According to the invention, said apparatus comprises a clearing jack, whereof one chamber can be connected to the pipe, said jack having a piston performing a reciprocating movement which is imparted thereto by a motor jack, via a mechanical link, said movement having the effect of producing pressure waves in the system, the motor jack being supplied by a hydraulic pressure source, via a servovalve controlled by a regulator sensitive to the output signals supplied by at least one transducer connected to the motor jack and input signals supplied by a signal generator, in order to give the pressure waves in the chamber of the clearing jack the form of harmonic-rich waves.

In order to permit the regulation of the compliance of the pipe, said apparatus also comprises a regulatable compliance device communicating with the chamber of the clearing jack.

According to another aspect of the invention, in order to avoid any risk of the pipe bursting or fracturing, safety means are provided for interrupting the supply of the motor jack when a detector sensitive to the pressure in the chamber of the clearing jack detects a rise in said pressure to above a predetermined pressure threshold, as well as when the frequency of the pressure waves, measured by the signal generator, exceeds a predetermined frequency threshold.

BRIEF DESCRIPTION OF DRAWINGS

A preferred embodiment of the invention is described in greater detail hereinafter in a non-limitative manner with reference to the attached drawings, wherein show:

FIG. 1 shows a pipe 10 filled with liquid 12 and in which a plug 14 has formed, which it is wished to eliminate. For this purpose, to the end of pipe 10 is connected a remote clearing or unblocking apparatus designated by the general reference 16. According to the invention, said apparatus 16 is designed to apply to the end of the pipe harmonic-rich, longitudinal pressure waves.

Figure 1:
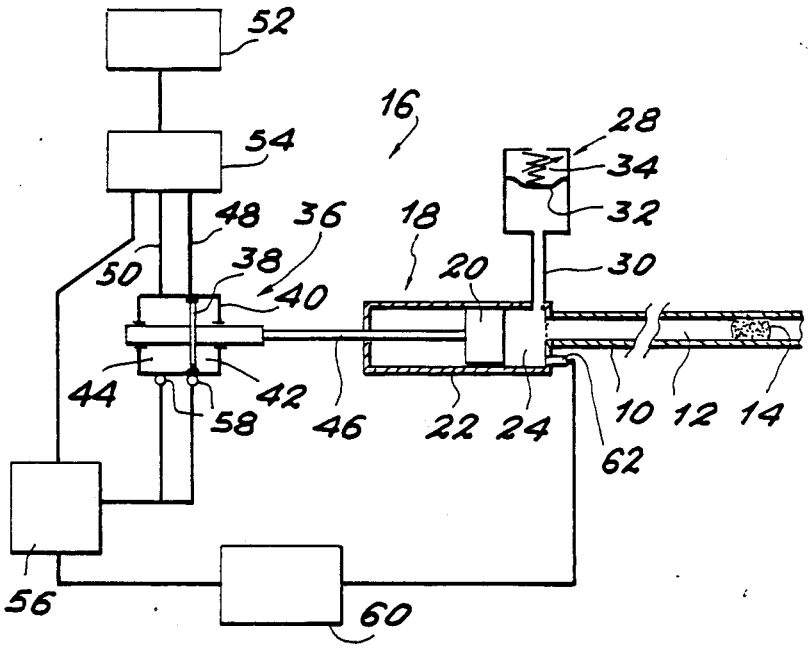
FIG. 1—A view diagrammatically showing a remote clearing apparatus according to the invention connected to a pipe to be cleared, the mechanical support connections not being shown.

Apparatus 16 comprises a clearing jack 18 formed by a piston 20 slidingly received in a cylinder 22, within which it defines a chamber 24. The cylinder 22 is provided with a conventional, not shown connecting means by which the end of pipe 10 communicates directly with chamber 24.

The clearing jack 18 is provided with a regulatable compliance volume 28 communicating with the chamber 24 by a pipe 30. Within the said volume 28, the liquid admitted by pipe 30 is in contact with an elastic diaphragm 32. A compression spring 34 is interposed between the opposite face of diaphragm 32 and the bottom of the volume. The internal diameter of said volume and the spring can be modified. In this way it is possible to regulate the compliance of the system formed by the pipe 10 filled with liquid 12. Therefore liquid 12 is present both in the chamber 24, the volume 28 beneath diaphragm 32 and pipe 10. The clearing apparatus 16 also comprises a motor jack 36 controlling the clearing jack 18.

More specifically, the motor jack 36 is a conventional double-action jack formed by a piston 38 slidingly received in a cylinder 40, within which it defines an upstream chamber 42 and a downstream chamber 44.

A mechanical connection, constituted in the represented embodiment by a rigid rod 46, connects the pistons 20 and 38 of jack 18 and 36, which for this purpose are axially aligned. Thus, pistons 20 and 38 are remotely joined, in such a way that they move jointly.

The front and rear chambers 42, 44 respectively of the motor jack 36 alternatively communicate via two pipes 48, 50 with a hydraulic pressure source, which is constituted by a conventional hydraulic unit 52.

The pressurized fluid supply to chambers 42 or 44 of motor jack 36 takes place via a servovalve 54. The latter is controlled by a regulator 56 sensitive to the signals supplied by one or more transducers 58 associated with the motor jack 36. For example, the transducers 58 comprise a transducer measuring the displacement of piston 38 of motor jack 36 and a transducer measuring the pressure in the two chambers 42, 44 of said jack.

Regulator 56 compares the signals supplied by transducers 58 with control signals emitted by an electronic pulse generator 60, said latter signals representing the shape of the pulse train to be obtained, in order to control the opening and closing of the servovalve 52 in the desired manner.

According to the invention and for the reasons which will become more readily apparent hereinafter, the motor jack 36 and therefore the clearing jack 18 are excited by harmonic-rich pressure waves, which in practice are constituted by pulse trains.

The operational security is ensured by a pressure transducer 62, which is sensitive to the pressure prevailing in chamber 24 of the clearing jack 18 in order to emit a stop signal when said pressure reaches or exceeds a predetermined threshold. In the same way, the pulse generator 60 comprises a device for measuring the frequency of the pulses and which also emits a stop signal when the frequency exceeds a given threshold. When one or both preset pressure and frequency thresholds are reached, generator 60 transmits a signal interrupting the supply to the motor jack 36. Thus, any untimely bursting or fracturing is prevented.

Experimental measurements have made it possible to reveal the variations of the pressure $P_2$ at plug 14 by varying the exciting frequency f in monotonic manner from 0 to 15 Hz. The corresponding graph is shown in FIG. 2, which has two maxima corresponding to the resonance peaks, whereof the frequencies are respectively designated $f_i$ and $f_c$ in FIG. 2.

Figure 2:
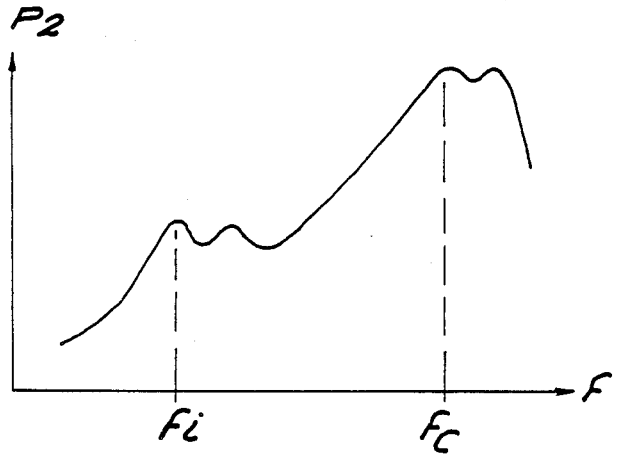
FIG. 2—The evolution of the pressure $P_2$ to the right of the plug formed in the pipe, as a function of the exciting frequency f of the pulse train.

The theoretical analysis of this result shows that the lowest natural frequency $f_i$ plotted on the graph of FIG. 2 corresponds to an incompressible mode of the longitudinal compression waves applied to the liquid column 12. According to this mode, liquid 12 behaves like an incompressible medium, i.e. the liquid column is not deformable. Therefore the pressure according to this mode is the same at any point in the column.

The second resonance peak of the graph of FIG. 2 and which corresponds to the natural frequency $f_c$, is a compressible mode in which the liquid 12 contained in pipe 10 behaves like a compressible medium, In this mode, the liquid column is deformable and the pressure varies along the pipe.

In reality, experience has shown that there are couplings between the compressible and incompressible modes. Thus, if under static conditions the pressure is identical at all points along the liquid column, as soon as there are low frequencies of about 1 Hz, the compressibility effects are felt and these effects increase in proportion with the level of the exciting frequency f. As the compressibility introduces a supplementary elasticity, the natural frequencies of the incompressible mode $f_i$ and the compressible mode $f_c$ in both cases tend to decrease with the exciting frequency f.

Figure 3:
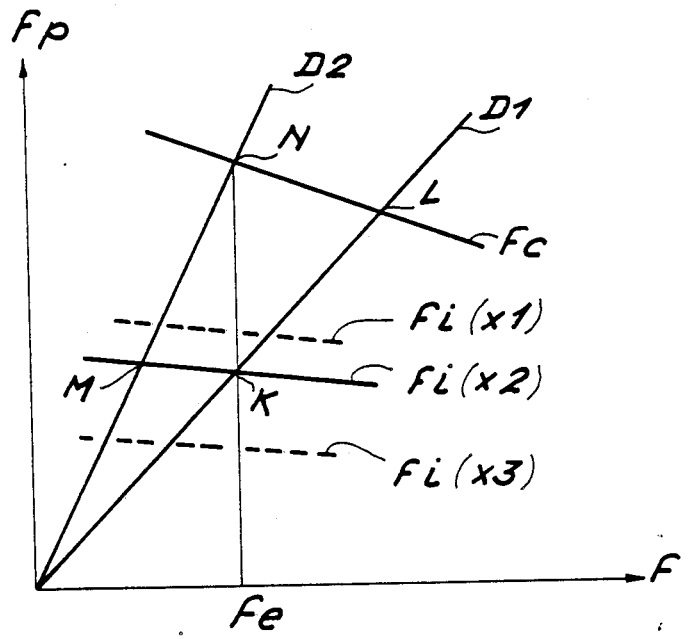
FIG. 3—The evolution of the natural frequencies $f_p$, respectively designated $f_i$ and $f_c$ for the incompressible and compressible modes of the system, as a function of the exciting frequency f, the evolution of the natural frequency $f_i$ of the incompressible mode being represented for three values $X_1$, $X_2$ and $X_3$ of the compliance of the regulatable compliance volume of the apparatus of FIG. 1.

This theoretical analysis is confirmed by FIG. 3, which shows the variations of the natural frequencies $f_p$ as a function of the exciting frequency f. More specifically, said FIG. 3 shows the variations of the natural frequency $f_i$ of the incompressible mode and the natural frequency $f_c$ of the compressible mode, as a function of the exciting frequency f.

This graph can be obtained experimentally with the aid of a spectrum analyzer, by means of which a frequency sweep is carried out, e.g. from 0 to 15 Hz. A certain number of successive spectra are then stored in the analyzer memory. On the basis of the thus stored values, it is possible to obtain information on the evolution of the different harmonics of the natural frequencies $f_i$ and $f_c$. It is possible to immediately derive the sought natural frequencies from the resulting graphs.

When the frequency $f_i$ or $f_c$ is equal to frequency f of the excitation or to the frequency of one of its harmonics, there is an increase in the movement of theliquid within the pipe. Thus, resonance conditions are established. This circumstance occurs at the intersection of graphs $f_i$ and $f_c$ with the lines $d_1$ of slope 1, $d_2$ of slope 2, etc. in FIG. 3.

Consequently the resonant frequencies relative to the harmonic 1 are the frequencies of points K and L on FIG. 3 and the resonant frequencies relative to harmonic 2 are the frequencies of points M and N.

Moreover, the natural frequency f of the incompressible mode can be likened to a mass-spring system. This natural frequency f is consequently given by the relation $$f_i = \frac{1}{2\pi} \sqrt{\frac{k}{m}},$$

in which m corresponds to the mass of the moving liquid and k is the stiffness, which is dependent both on the calibration of the compliant volume 28 of the apparatus and the elastic characteristics of the liquid 12 and its volume modulus. The regulation of the calibration of volume 28 consequently makes it possible to vary at random the frequency $f_i$ of the incompressible mode.

This characteristic is also illustrated in FIG. 3, which shows three different graphs of the evolution of frequency $f_i$ as a function of the exciting frequency f, said three graphs corresponding to three different values of the compliance X of the compliant volume 28. These three volumes are designated $X_1$, $X_2$ and $X_3$ in FIG. 3.

As shown in solid line form in FIG. 3, there is a value $X_2$ of the compliance of volume 28 for which, the system being excited at frequency $f_e$ equal to the resonant frequency of the incompressible mode of the liquid 12-pipe 10, system, the harmonic 2 of said frequency has the resonant frequency of the compressible mode. The resonance of the incompressible mode is obtained at point K of FIG. 3 and that of the compressible mode at point N thereof. By exciting the liquid column at this particular frequency, designated $f_e$ in FIG. 3, effective pressure waves can be obtained.

Moreover, these amplification effects are obtained at a relatively low exciting frequency $f_e$ and in particular below the exciting frequency of the harmonic 1 corresponding to the resonance of the compressible mode (frequency of point L in FIG. 3). This solution has the advantage of reducing the problems of the mechanical strength of the pipe, which are aggravated when the frequency increases.

However, the invention is not limited to the superimposing of the harmonic 2 of the resonant frequency of the incompressible mode and the harmonic 1 of the resonant frequency of the compressible mode illustrated in FIG. 3. Thus, a comparable effect, although more limited, would be obtained by regulating the compliance X of volume 28 in FIG. 1 in such a way that the frequency of the harmonics 1 or 3 of the resonant frequency of the incompressible mode would be equal to the frequency of harmonic 1 of the resonant frequency of the compressible mode.

Moreover, it is clear that the sought effect varies in the same sense as the richness in harmonics of the longitudinal pressure waves. This is why the clearing apparatus 16 according to the invention is designed so as to create a harmonic-rich pulse train.

Figure 4:
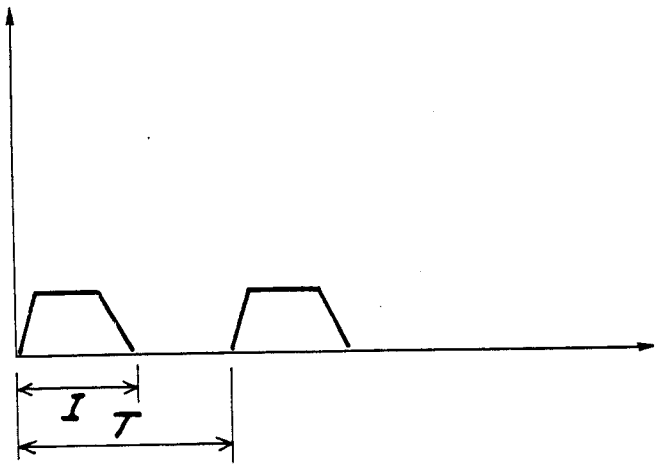
FIG. 4—An example of a usable pulse train, i.e. the evolution of the amplitude of said pulse train as a function of time.

In this preferred embodiment of the invention, according to which the excitation of the liquid column contained in the pipe to be cleared is obtained by creating within the apparatus 16 of FIG. 1 an adequate pulse train, the breaking down into a Fourier series of said pulse train shows that the importance of these different harmonics varies as a function of the value of the ratio between the duration I of each pulse and the period T of the pulse train (FIG. 4). According to an interesting aspect of the invention, said ratio I/T is preferably chosen in such a way that the harmonic n of the resonant frequency of the incompressible mode which is superimposed on harmonic 1 of the resonant frequency of the compressible mode is as preponderant as possible.

For example, the case shown in FIG. 2(n=2) leads, for a rectangular pulse train, to choosing the ratio I/T in the range between 0.20 and 0.30 or between 0.7 and 0.8. However, in the case where n=3 and still for a rectangular pulse train, the ratio I/T is preferably chosen in the range between 0.45 and 0.55 or, failing this, between 0.12 and 0.22 or 0.78 and 0.88.

I claim:

1. Process for the remote clearing of a pipe (10) filled with liquid (12), characterized in that to one end of the pipe are applied harmonic-rich longitudinal pressure waves at an exciting frequency $f_e$ equal to the resonant frequency of the harmonic 1 of an incompressible mode of the system formed by the liquid-filled pipe, after having regulated the compliance of said system in such a way that the harmonic n of said exciting frequency $f_e$ is at the frequency of harmonic 1 of the resonant frequency of a compressible mode of the system, n being an integer at least equal to 1.

2. Process according to claim, characterized in that pressure waves formed by a harmonic-rich pulse train are applied to the end of pipe (10).

3. Process according to claim 2, characterized in that the compliance of the system is regulated in such a way that the harmonic 1 of the resonant frequency of the incompressible mode has a harmonic 1 of frequency equal to the frequency of harmonic 1 of the resonant frequency of the compressible mode and in that the ratio between the duration I of a pulse and the period T of the pressure waves is adjusted to a value for which the coefficient of harmonic 1 of the development in the Fourier series of the pulse train is at a maximum.

4. Process according to claim 2, characterized in that the compliance of the system is regulated in such a way that the harmonic 1 of the resonant frequency of the incompressible mode has a harmonic 2 of frequency equal to the frequency of harmonic 1 of the resonant frequency of the compressible mode and in that the ratio between the duration I of a pulse and the period T of the pressure waves is adjusted to a value for which the coefficient of harmonic 2 of the development in the Fourier series of the pulse train is at a maximum.

5. Process according to claim 2, characterized in that the compliance of the system is regulated in such a way that the harmonic 1 of the resonant frequency of the incompressible mode has a harmonic 3 of frequency equal to the frequency of harmonic 1 of the resonant frequency of the compressible mode and in that the ratio between the duration I of a pulse and the period T of the pressure waves is adjusted to a value for which the coefficient of harmonic 3 of the development in Fourier series of the pulse train is at a maximum.

6. Process according to any one of the claims 1 to 5, characterized in that the exciting frequency at resonance f is below 20 Hz.

* * * * *